US005465975A

United States Patent [19]

Shull et al.

[11] Patent Number: 5,465,975

[45] Date of Patent: Nov. 14, 1995

[54] DEAD HAND CARD GAME AND METHOD OF USE

[76] Inventors: Naomi S. Shull, 4222 Martha Ct., Pascagoula, Miss. 39581; Mary L. Shoun, Rte. 5, Box 120, Mountain City, Tenn. 37683

[21] Appl. No.: 205,559

[22] Filed: Mar. 4, 1994

[51] Int. Cl.[6] ..... A63F 1/00

[52] U.S. Cl. ..... 273/295; 273/290; 273/DIG. 24

[58] Field of Search ..... 273/292, 296, 273/295, 303, 306, 288, 290, DIG. 24

[56] References Cited

U.S. PATENT DOCUMENTS

| | | | |
|---|---|---|---|
| D. 45,449 | 3/1914 | Down | 273/303 X |
| 178,863 | 6/1876 | Levy | 273/303 |
| D. 269,447 | 6/1983 | Raheb | 273/303 X |
| 298,991 | 5/1884 | Levey | 273/305 |
| D. 910,004 | 11/1933 | Crompton | 273/303 X |
| 927,119 | 7/1909 | Cohen | 273/303 |
| 952,939 | 3/1910 | Parker | 273/303 |
| 5,112,059 | 5/1992 | Mundle et al. | 273/303 X |
| 5,141,235 | 8/1992 | Hernandez | 273/303 X |

FOREIGN PATENT DOCUMENTS

| | | | |
|---|---|---|---|
| 700270 | 11/1953 | United Kingdom | 273/303 |

OTHER PUBLICATIONS

Registration of Copyright, Vincent Picataci, "The Game of Extra" ©Nov. 4, 1973.

*Primary Examiner*—William E. Stoll

[57] ABSTRACT

A card game played with a dead hand comprising, a deck of cards, the deck being divided into four suits, indicia on the back side of each card representative of the fifteen cards in each suit, such back side indicia including stars, moons, rockets and comets, indicia on the front side of each card having one of the four suits, plus the numbers 2 through 14 plus two trump cards marked with a T, the cards being formed of a somewhat relatively flexible material. The indicia is preferably formed of florescent material. Tokens are also provided, preferably fabricated with florescent material. Also provided is a box for exposing the cards and tokens to irradiating light.

1 Claim, 4 Drawing Sheets

DEAD HAND CARD GAME AND METHOD OF USE

BACKGROUND OF THE INVENTION

1. Field of the Invention

The present invention relates to dead hand card games and more particularly pertains to a card game having cards and tokens with florescent material and further including a box for illuminating such florescent material.

2. Description of the Prior Art

The use of card games is known in the prior art. More specifically, card games heretofore devised and utilized for the purpose of entertainment and competition are known to consist basically of familiar, expected and obvious structural configurations, notwithstanding the myriad of designs encompassed by the crowded prior art which have been developed for the fulfillment of countless objectives and requirements.

The prior art discloses various types of games including card games. By way of example, U.S. Pat. No. 4,369,976 to Chun discloses a set of cards of animal configurations.

U.S. Pat. No. 5,112,059 to Mundle discloses cards in the game with a large plurality of cards per set and with the set including non-numbered cards.

U.S. Pat. No. 4,955,619 to Christman discloses a card game with a board for the receipt of the card.

U.S. Pat. No. 5,125,669 discloses numbered cards for a game employing a plurality of colors and a large number of numerals.

Lastly, U.S. Pat. No. 4,480,840 to Chang discloses a multi-suit card game employing celestial bodies and terrestrial cards in combination.

In this respect, the dead hand card game according to the present invention substantially departs from the conventional concepts and designs of the prior art, and in so doing provides an apparatus primarily developed for the purpose of increased entertainment and competition.

Therefore, it can be appreciated that there exists a continuing need for new and improved dead hand card game. In this regard, the present invention substantially fulfills this need.

SUMMARY OF THE INVENTION

In view of the foregoing disadvantages inherent in the known types of card games now present in the prior art, the present invention provides an improved dead hand card game. As such, the general purpose of the present invention, which will be described subsequently in greater detail, is to provide a new and improved dead hand card game and method of use apparatus and method which has all the advantages of the prior art dead hand card game and none of the disadvantages.

To attain this, the present invention essentially comprises a card game ploy a dead hand with associated components comprising, in combination, a card game played with a dead hand and having associated components comprising, in combination, a deck of 60 cards, the deck being divided into four sets, indicia on the back side of each card representative of one of the sets, such back side indicia including stars, moons, rockets and comets, indicia on the front side of each card including one of the four types of indicia plus the numbers 2 through 14 plus two trump cards marked with a T, each card being formed of a relatively flexible material with the indicia on the front and back sides formed of florescent material whereby when exposed to light for a period of time the material will subsequently irradiate light energy during play. Also provided is a plurality of tokens of a circular shape in a flat configuration with alignment apertures therethrough adjacent to diametrically opposed edges, florescent material formed on the surfaces of each token adapted to irradiate light energy for a period of time subsequent to being exposed to light. Lastly provided is a housing for the receipt of individual cards of the deck and tokens, the housing including a source of light and mirrors to reflect the light throughout the housing and to the surface of the cards and the tokens to irradiate the florescent material of the cards and chips.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dead hand card game which has all the advantages of the prior art card games and none of the disadvantages.

It is another object of the present invention to provide a new and improved dead hand card game which may be easily and efficiently manufactured and marketed.

It is a further object of the present invention to provide a new and improved dead hand card game which is of a durable and reliable construction.

An even further object of the present invention is to provide a new and improved dead hand card game which is susceptible of a low cost of manufacture with regard to both materials and labor, and which accordingly is then susceptible of low prices of sale to the consuming public, thereby making such dead hand card games economically available to the buying public.

Still yet another object of the present invention is to provide a new and improved dead hand card game which provides in the apparatuses and methods of the prior art some of the advantages thereof, while simultaneously overcoming some of the disadvantages normally associated therewith.

Still another object of the present invention is to entertain players of card games.

Yet another object of the present invention is to promote competition among players of games of chance.

Even still another object of the present invention is to provide a new and improved card game ploy a dead hand with associated components comprising a deck a card game played with a dead hand comprising a deck of cards, the deck being divided into four sets, indicia on the back side of each card representative of one of the sets, such back side indicia including four celestial objects, indicia on the front side of each card including one of the four types of back side indicia plus the numbers 2 through 14 plus two trump cards marked with a T, the cards formed of a relatively flexible material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numeral refers to the same part through the various Figures.

DESCRIPTION OF THE PREFERRED EMBODIMENT

Figure 1:
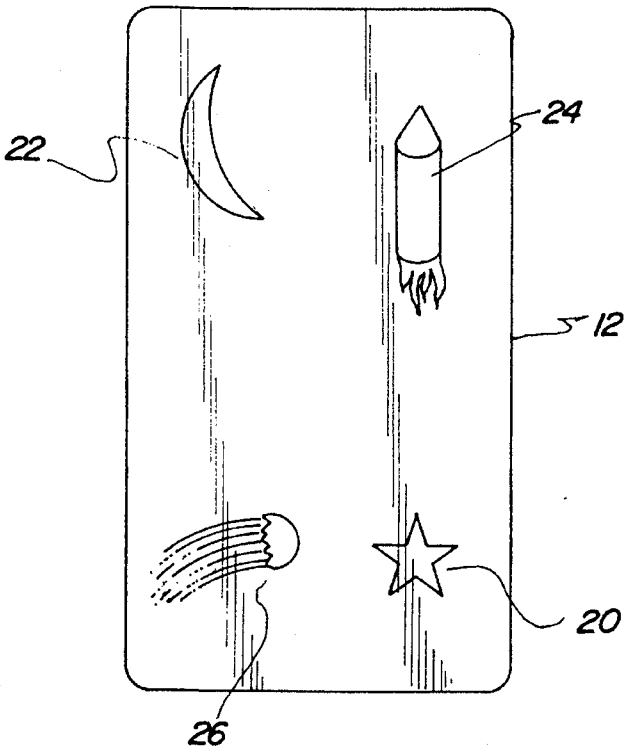
FIG. 1 is a perspective view of the back side of one of the cards constructed in accordance with the principles of the present invention.
Figure 2:
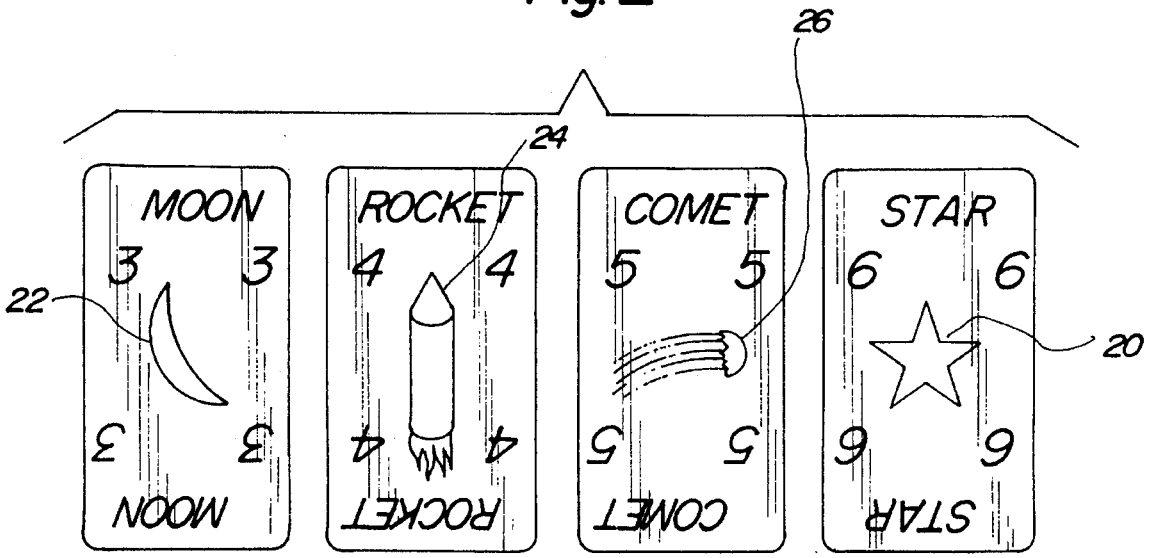
FIG. 2 illustrates the front side of a particular card of each type of card.
Figure 3:
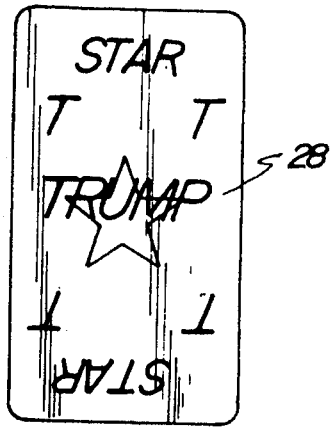
FIG. 3 illustrates the front side of a trump card of the deck.
Figure 4:
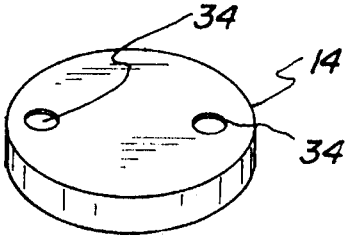
FIG. 4 is a perspective view of one of the tokens or playing pieces.
Figure 5:
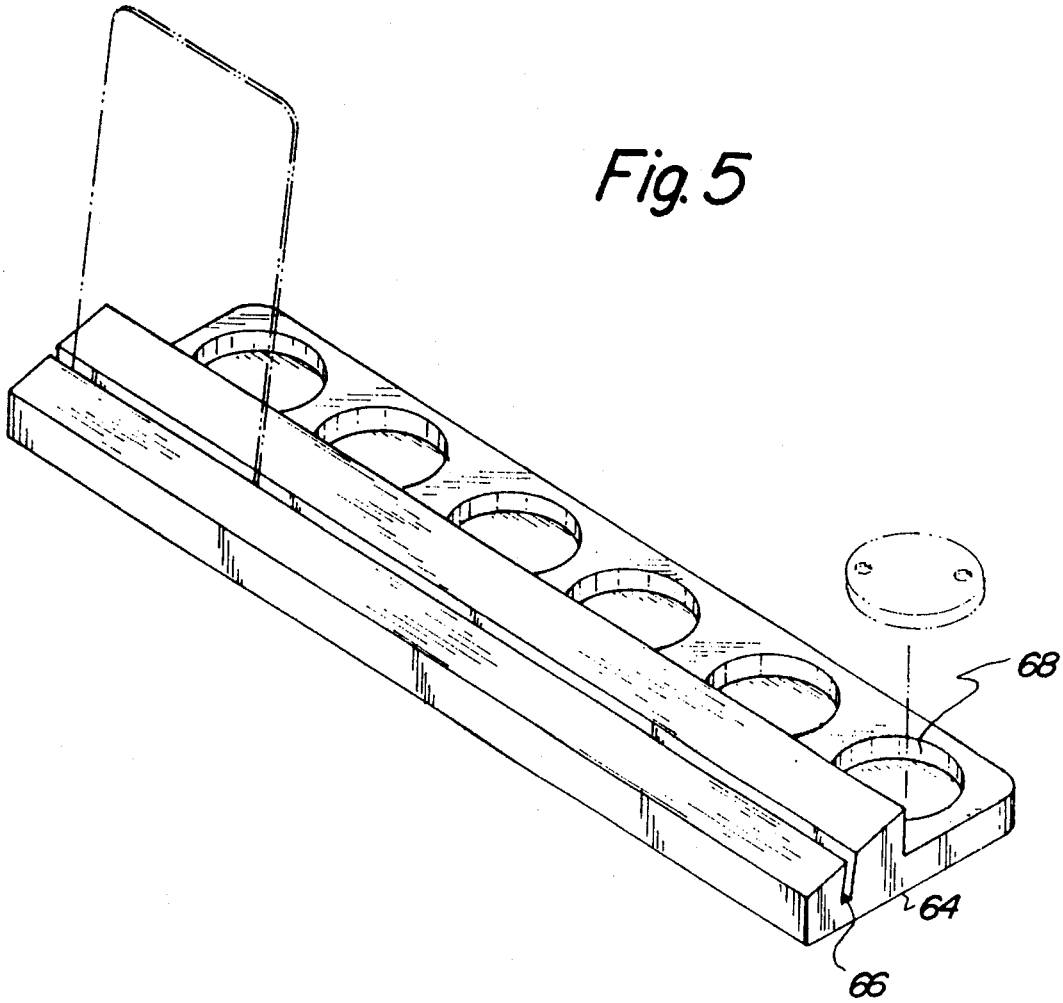
FIG. 5 is a holder for the tokens and cards for use during play.
Figure 6:
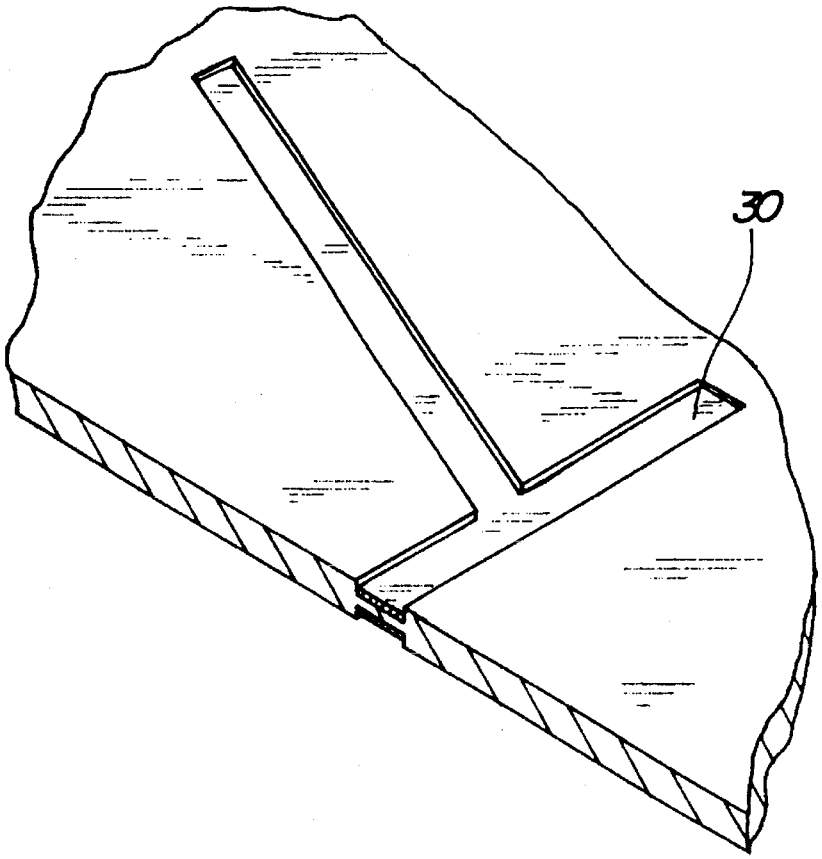
FIG. 6 is a sectional view of one portion of the card illustrating the florescent material on both sides thereof.
Figure 7:
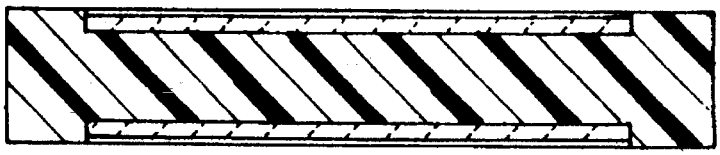
FIG. 7 is a sectional view of the card of FIG. 6 showing in greater detail the florescent material in the chip.
Figure 8:
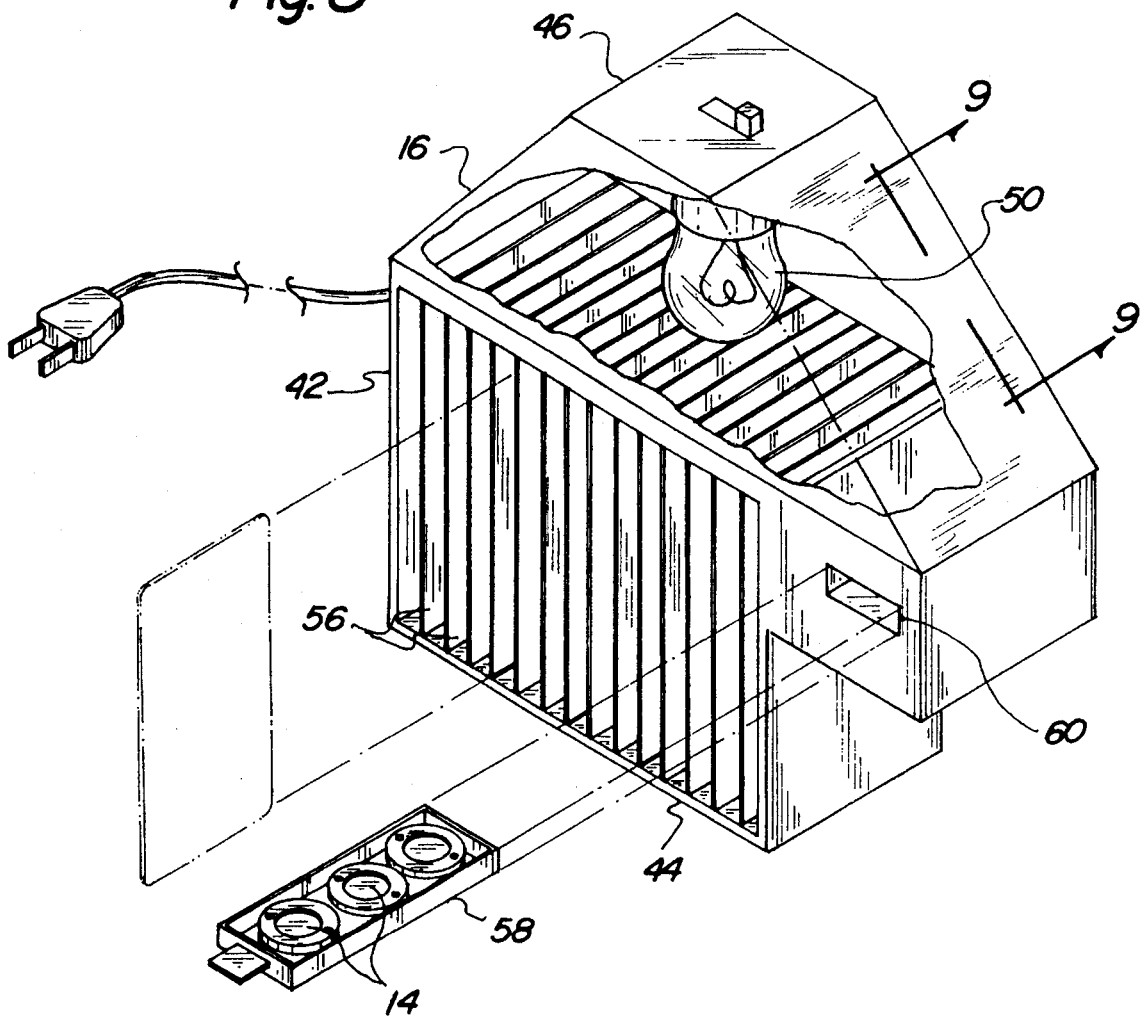
FIG. 8 is a perspective view of a housing 4 irradiating the florescent material of the cards and chips.
Figure 9:
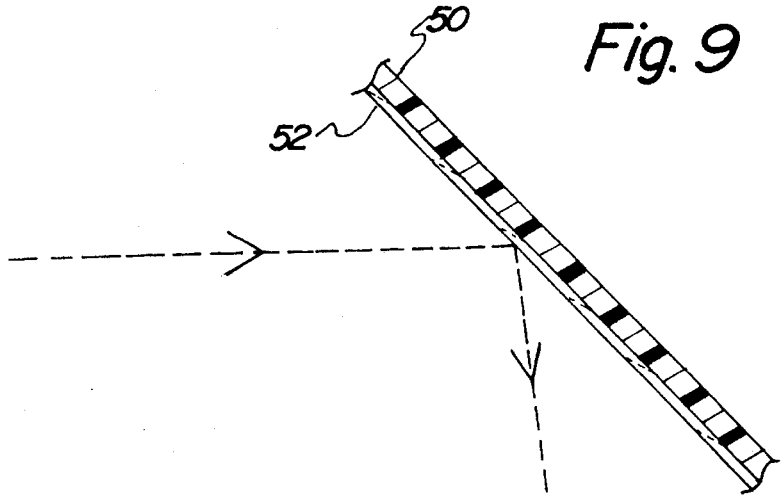
FIG. 9 is a sectional view taken along line 9—9 of FIG. 8.

With reference now to the drawings, and in particular to FIG. 1 thereof, a new and improved dead hand card game embodying the principles and concepts of the present invention and generally designated by the reference numeral 10 will be described.

More specifically, it will be noted in FIGS. 1 through 3, 6 and 7 that the present invention is directed to a card game 10 played with cards 12. The game includes the use of a dead hand. The game, in its broadest of terms includes the cards 12, tokens 14 and a housing 16 for such cards and tokens.

Specifically, the cards 12 employed are 60 in number which form a deck. The deck is divided into four sets. Indicia on the back side of each card is representative of all of the sets. Such back side indicia includes stars 20, moons 22, rockets 24 and comets 26. Note FIG. 1.

Indicia is also provided on the front side of each card. Included front side indicia includes one of the four types of indicia. Note FIG. 2. Frontside indicia also includes the numbers 2 through 14. Note FIG. 3. In addition to a number 2 through 14 two trump cards 28 marked with a T for each set.

Each card is formed of a relatively flexible material with the indicia on the front and back sides formed of florescent material 30. Note FIGS. 6 and 7. In this manner when exposed to light for a period of time the material 30 will subsequently irradiate light energy during play.

Also included as part of the game are a plurality of tokens 14. The tokens 14 are each of a circular shape in a flat configuration. Alignment apertures 34 extend therethrough adjacent to diametrically opposed edges. The apertures allow the chips to be placed on parallel rods for alignment purposes. Like the cards 12, a florescent material is formed on the surfaces of each token. Such florescent material is adapted to irradiate light energy for a period of time subsequent to being exposed to light.

Another part of the game is a housing 16. The housing is for the receipt of individual cards 12 of the deck as well as for tokens 14. The housing includes side walls 42, a floor 44 and an arched roof 46. A source of light 50 and mirrors 52 are provided in the roof to reflect the light throughout the housing and to the surface of the cards and the tokens. Such light functions to irradiate the florescent material of the cards and chips to add an element of interest to the game. To ensure proper irradiation, the cards are supported upright by transparent vertical plates 56. The chips are supported on a tray 58 removably received in a slot 60.

For convenience of play, each player is provided with a tray 64. The tray is a rigid elongated member with a slot 66 which allows the player to support his or her cards 12 in an erect position out of view of all opponents. The tray also includes wells 68 for the receipts of tokens 14. The tokens in the wells are within the view of the opponents.

For playing a card game, items needed are one set of cards with two trump cards and one box of tokens. (Paper clips, coins, etc. could be used as a substitute).

The object of the game is to collect all the tokens from all the trump cards in the center of the board or table and from all the other players. This is done by going through the suits of the cards to play a trump card so that you can collect the tokens on that card in the center of the board table. The first player to play all his or her cards collects one token for each card every other player is still holding.

Four, six, or eight players can play. The four extra trump cards are placed in the center of the board or table. Each player is given 30 tokens with which to play.

Each player places one token on each card in the center, this is called "Ante Up". This is repeated at the beginning of each new hand. The dealer deals the cards to his right until all the cards are out giving himself two hands. The deal goes to the next dealer to the right with the deal of each new hand. The dealer may pick up either hand, if he or she does not want to play this hand. Alternating he or she can exchange it for the other hand. If he or she does not exchange hands he or she can sell or swap the extra hand for tokens to another player. The unused hand then becomes the "Dead Hand" and is kept beside the dealer. It is not picked up again through the hand being played. Once the extra hand is looked at by anyone it is dead for the rest of the hand.

The play always starts with the two of Stars. If the two is in the "Dead Hand" then the three begins or, if not, then the four or the next lowest Star card will start the game. Each card is called out as it is played and placed in front of the player playing it.

The suit is broken when a card needed for play is in the "Dead Hand", like the eight or nine of stars, etc. Then the last player that played a card changes card suits to Moons, or Comets, etc. and plays the lowest card of the suit he or she has in his or her hand and the game goes on from there.

Each time a card comes up in the "Dead Hand" the suit must always be changed by the last player to play a card. Suits can be changed back and fourth throughout the hand.

This play goes on until a player plays a trump card. This player takes the tokens on the same card in the center of the board or table. He then changes suits and starts again. If a player can not change suits, the play falls to the next player on his right who changes suits and restarts the game.

The player to play all his cards and goes out, collects one token for each card every other player is still holding. The first player to take all the tokens from the trump cards in the center of the board or table, and from all other players wins the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A card game apparatus played with a dead hand comprising:

a deck of cards, the deck being divided into four sets, indicia on the back side of each card representative of the sets, such back side indicia including four celestial objects, indicia on the front side of each card including one of the four types of back side indicia plus the numbers 2 through 14 plus two trump cards marked with a T, the cards formed of a relatively flexible material;

a plurality of tokens with alignment apertures through each token adjacent to diametrically opposed edges; and florescent material formed on the surface of each token adapted to irradiate light during the play of the game and subsequent to being exposed to light.

* * * * *